US005123553A

United States Patent [19]

Burt, III

[11] Patent Number: 5,123,553

[45] Date of Patent: Jun. 23, 1992

[54] DISCONNECT TOOL FOR USE WITH HIGH VOLTAGE EQUIPMENT

[76] Inventor: Frederick W. Burt, III, 24 Mountain Hill Rd., Plymouth, Mass. 02360

[21] Appl. No.: 600,422

[22] Filed: Oct. 19, 1990

[51] Int. Cl.[5] ..... B61G 1/10

[52] U.S. Cl. ..... 213/162; 254/121; 294/18

[58] Field of Search ..... 213/162, 175, 178; 294/18; 254/43, 44, 121; 7/169

[56] References Cited

U.S. PATENT DOCUMENTS

| | | | |
|---|---|---|---|
| 24,420 | 6/1859 | Warren | 213/211 |
| 916,858 | 3/1909 | Geisking | 294/18 |
| 2,072,391 | 6/1937 | Varney | 294/18 |

*Primary Examiner*—Joseph F. Peters, Jr.
*Assistant Examiner*—Virna Lissi Mojica
*Attorney, Agent, or Firm*—Thomas A. Kahrl

[57] ABSTRACT

A disconnect tool for use with a plurality of vehicles powered by a source of high voltage electricity and method of disconnecting high voltage equipment, which disconnect tool comprises a disconnect means for moving a coupling between a coupled position and an uncoupled position, an elongated disconnect member of lightweight rigid construction having a non-conductive shaft and a non-conductive coating, including a non-conductive handle, a non-conductive shaft and a non-conductive hook means for engaging the coupling, and including a non-conductive surface layer for preventing high voltage from passing from the transit vehicle to the handles of the user. The method of disconnecting comprises coupling a first vehicle to a second vehicle, mechanically engaging the first coupling means manually grasping an elongated disconnect tool, moving the disconnect lever between a connected position and a disconnected position by pulling the disconnect tool outwardly.

8 Claims, 2 Drawing Sheets

DISCONNECT TOOL FOR USE WITH HIGH VOLTAGE EQUIPMENT

BACKGROUND OF THE INVENTION

Uncoupling rail vehicles, particularly two rail transit cars, which have electric motors powered by a high voltage source, the vehicles being constructed to be coupled together by a draw bar and to operate on a pair of steel tracks utilizing a separate "live" third rail for a source of 600 volts voltage power, is typically done manually by rail operators working in close proximity to the rail vehicles and the third rail. The third rail, as the name suggests, is located adjacent one of the two steel tracks and being positioned off the ground poses serious life threatening safety hazards to rail personnel due to the risk of accidental touching the third rail when engaged in the draw bars in coupling and uncoupling such transit vehicles. Generally, rail or transit crew personnel engaged in connecting the two rail vehicles together and in particular disconnecting them by manual operation of installed draw bar connected to coupling tool installed in each of the rail vehicles, must work in close proximity to the "live" third rail, and furthermore in grasping the draw bar typically of metallic construction operating the couplings either manually or engaging the draw bar by use of a metal tool, run great risk of severe electrical shock from stray voltage around the draw bar or electrocution by accidentally touching the third rail with the tool resulting in death or severe injury.

It is therefore desirable to provide for a new and improved disconnect tool and method for use of the disconnect tool with high voltage equipment whereby the operator is given protection by a non-conductive disconnect tool member from the risk of accidental shock caused by short circuits or stray voltage during operating the draw bar for uncoupling of the electrically powered transit rail equipment, and from the risk of accidentally touching the live third rail by providing an elongated insulated disconnect device to keep the operator at a distance from the third rail.

SUMMARY OF THE INVENTION

The invention relates to an improved disconnect tool for use with disconnecting two rail vehicles mechanically coupled together powered by high voltage equipment and for a method of connecting and disconnecting high voltage equipment.

In particular, an improved disconnect tool for use with two rail vehicles, typically transit cars, powered by electric motors connected to a high voltage source has been discovered applicable for manually moving coupling linkages connecting the two vehicles by an operator between a connected position and a disconnected position with a tool having a non-conductive insulating barrier between the coupling linkage and the high voltage source and the hands of the operator. The disconnect tool is of elongated construction of electrically non-conductive material comprising a shaft member of lightweight rigid construction having a one end and other end including an electrically non-conductive handle securely attached to the one end comprised of a pair of handle bars and a hook means securely attached to the other end of the shaft member.

The hook means including an arcuate inner hook surface, a right angle bend at a joint, a second right angle bend and a prong extending outwardly is adapted to engage an operating lever of known metallic construction of conventional mechanical couplings for electrically powered rail cars. The tool includes a non-conductive outer layer typically a sheet of Royalite, heat resistant, rigid ABS thermoplastic sheet, for preventing high voltage from passing from the transit vehicle via the operating lever to the hands of the user, the outer layer covering the entire external surface of the disconnect tool. In operation the pair of handle bars of the disconnect tool may be grasped by each hand of the operator to manipulate the disconnect tool to engage mechanical switching apparatus of high voltage equipment for moving the switching apparatus between a connected position and an unconnected position.

In another aspect, the invention features a method of disconnecting a rail vehicle powered by high voltage apparatus having a mechanical coupling from a second rail vehicle powered by a high voltage apparatus, both having a live third rail as a source of electrical power, having a mating mechanical connection comprising the steps of, providing a first coupling means on the first high voltage vehicle and a second coupling means on a second rail vehicle, mechanically engaging the first coupling means to the second coupling means to hold the two rail vehicles in mechanical connection, connecting the rail vehicles high voltage apparatus to a source of power, preferably a third rail, by manually grasping an elongated disconnect tool by a pair of handles, providing a disconnect shaft extending from the first coupling means, engaging the disconnect shaft extending from the first coupling means with the hook end of the disconnect tool for moving the disconnect lever between a connected position and a disconnected position, pulling the disconnect tool outwardly causing the first coupling means to uncouple from the second coupling means.

In yet another aspect of the invention features an improved disconnect tool for use with a subway transit car powered by a source of high volt electricity, the source of power comprising a third rail, the car having an electrical connect member hingably connected to the rail cars electric motor for movement between an engaged conductive position adjacent the third rail and a disengaged non-conductive position in spaced relationship with the third rail, the disconnect tool having a non-conductive shaft having a one end and an other end, a non-conductive handle at the one end and a non-conductive hook member at the other end wherein the handle may be grasped by an operator and the hook member used to move the shoe member into the engagement with the third rail to energize the motor or alternatively disengage the shoe member from the third rail thereby deenergizing the motor.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

DESCRIPTION OF THE EMBODIMENTS

Figure 1:
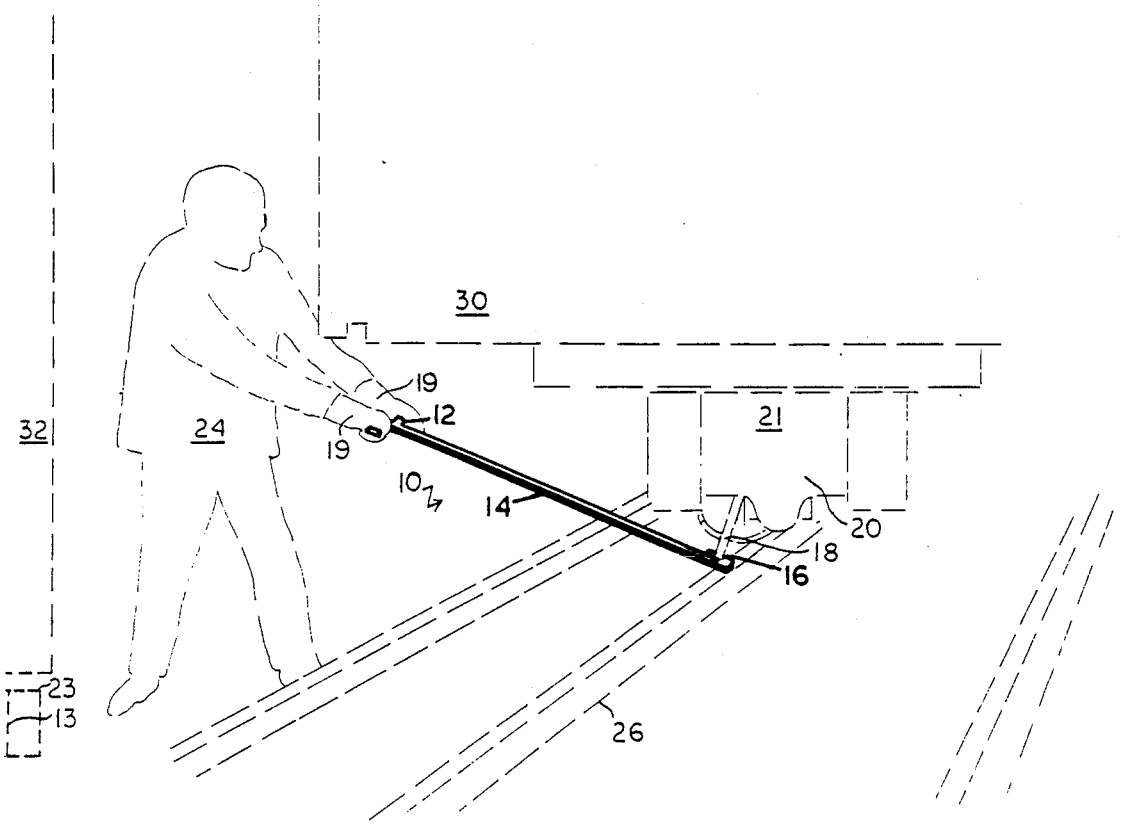
FIG. 1 is a perspective view of the disconnect tool of the invention in engagement with a disconnect shaft, the disconnect tool being held by an operator.
Figure 2:
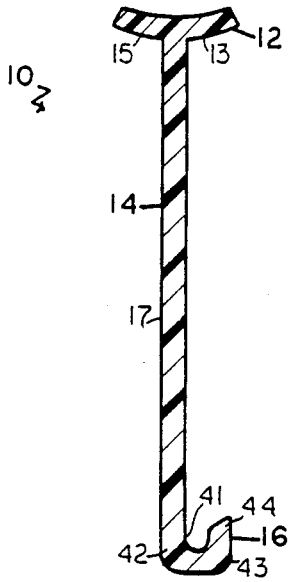
FIG. 2 is a view in section of the disconnect tool of the invention shown in FIG. 1.

FIGS. 1 & 2 show a disconnect tool 10 for engaging a coupling 21 joining two electrically powered rail cars 30 and 32 connected by a shoe member 13 to a third rail 26 providing a source of high voltage electricity.

In particular rail car 30 includes a coupling 21 and rail car 30 includes a mating rail car coupling 23, of conventional construction comprising a first jaw member 20 attached to the rail car 32 and a second jaw member 22 attached to rail car 30 an operating lever 18, typically constructed of metal, extending outwardly from jaw member 20 to be accessed by an operator 24 to be moved between a coupled position and a disconnect position for disconnecting the two rail cars 30 and 32.

As shown in FIG. 1, the disconnect tool 10 comprises an elongated shaft 14 constructed of lightweight, electrically non-conductive and resilient material; having a one and other end; a handle 12 constructed of non-conductive material integrally attached to the one end of the shaft 14, typically including a pair of opposed handle bars 13 and 15 extending outwardly in perpendicular relationship to the shaft 14, a hook 16 securely attached to the other end of the shaft and a surface layer 17 constructed of non-conductive material, typically a sheet of Royalite covers the entire outer surface of the disconnect tool for insulating the hands 19 of the operator 24 from accidental electrical shock. The electric shock could be caused by stray voltage in the coupling, which is mechanical in nature but of metallic construction conductive to electrical current originating in the third rail as a source of power. Alternatively, electrical shock could be caused by accidentally touching the third rail with the disconnect tool, the third rail being in close proximity to the coupling 21 and operating lever 18.

In a preferred embodiment of the invention the hook 16 comprises an inner hook surface 41, a first right angle bend 42 a joint with shaft a second right angle bend 43 and a prong 44 having a sloped distal end.

Figure 3:
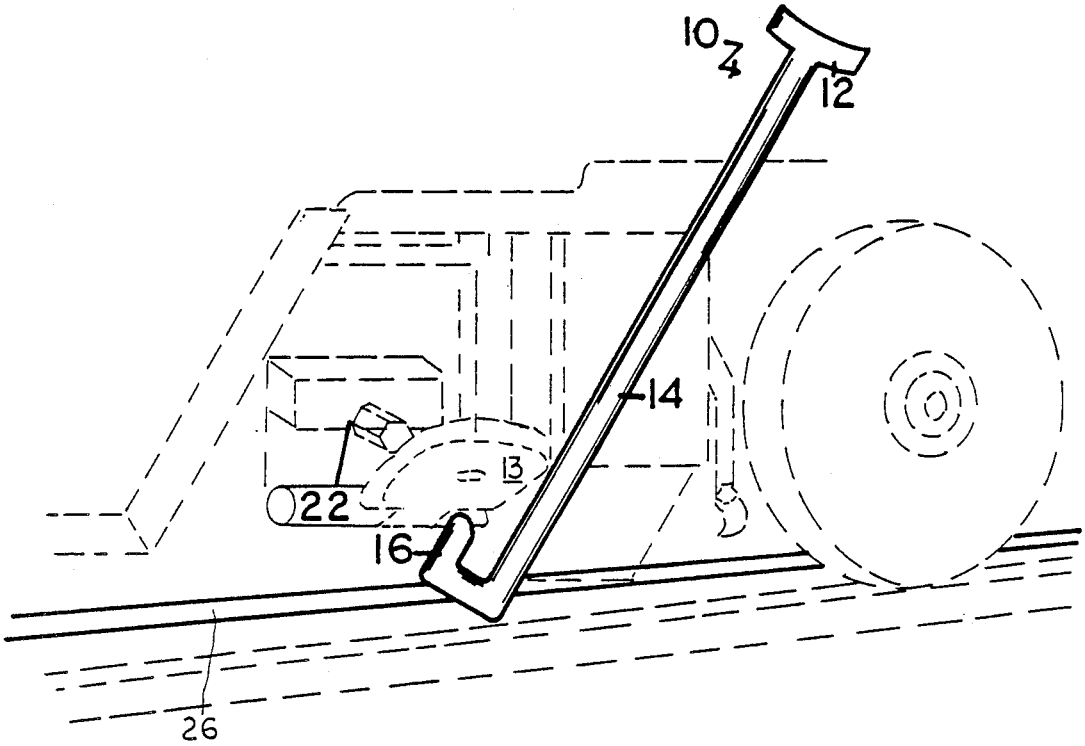
FIG. 3 is a perspective view of the disconnect tool according to the invention shown with a shoe shown in dotted lines for contacting a third rail also shown in dotted lines.

In another embodiment of the invention shown in FIG. 3 the rail cars include electrical apparatus 22 for engaging the rail cars including a shoe member 13 hingedly mounted for movement between an engaged position with the shoe 13 contacting the third rail 26 and a disconnect position by manipulation by the disconnect tool 10 by an operator.

What is claimed is:

1. A disconnect tool for use with a rail vehicle system comprising a plurality of electrically powered rail vehicles connected to a source of high voltage electricity said rail vehicle system further comprising;

a) a first and second rail vehicle;

b) a first coupling means for connecting the first rail vehicle to the second rail vehicle;

c) an operating lever means for moving the coupling between a coupled position and an uncoupled position said tool comprising;

a disconnect means for engaging the operating lever means for manually moving the coupling means between a coupled position and an uncoupled position said disconnect means further comprising;

i) an elongated non-conductive shaft of lightweight rigid construction having a one and other end;

ii) a non-conductive handle means to be grasped by an operator securely attached to the one end of the non-conductive shaft comprised of a pair of opposed handle bars extending outwardly in generally perpendicular manner from the shaft;

iii) a hook means for engaging the operating lever means and securely attached to the other end of the handle;

iv) a non-conductive surface layer covering the entire outer surface of the disconnect tool for preventing high voltage from passing from the transit rail vehicles or from the high voltage to the hook means and thence the hands of the operator.

2. The disconnect tool of claim 1 wherein the hook means comprises an arcuate inner hook surface, a first right angle bend, a second right angle bend and a prong extending outwardly.

3. The disconnect tool of claim 2 wherein the non-conductive surface layer comprises a non-conductive layer overlaying the entire external surface of the disconnect tool.

4. The disconnect tool of claim 3 wherein when the coupling member is in the coupled position the first rail vehicle is connected to the second vehicle.

5. The disconnect tool of claim 4 wherein when the coupling member is in the uncoupled position the first rail vehicle is disconnected from the second vehicle.

6. The disconnect tool of claim 5, wherein the non-conductive handle means comprises first and second handles fixably secured to the shaft comprised of a pair of opposed handle bars extending outwardly in a generally perpendicular manner from the shaft, the handles permitting the disconnect tool to be lifted and manipulated by an operator.

7. A disconnect apparatus for use in combination with electrical-switching apparatus for high voltage transit equipment adapted to operate on railroad tracks utilizing a third rail as a source of power said electrical-switching apparatus comprising;

a) a source of power comprising a third rail;

b) a rial vehicle powered by electrical apparatus having a connector means for electrically connecting the electrical apparatus to the third rail;

c) a hinge means for permitting the connector means to move between an engaged position in contact with the third rail and an uncoupled position said disconnect apparatus comprising;

a disconnect tool for engaging the connector means and for moving said connector means between a engaged position and a disengaged position said disconnect tool comprising;

i) an elongated non-conductive shaft of lightweight rigid construction having a one and other end;

ii) a non-conductive handle means securely attached to the one end of the non-conductive shaft comprised of a pair of opposed handle bars extending outwardly in generally perpendicular manner from the shaft;

iii) a hook means for engaging the operating lever means and securely attached to the other end of the handle;

iv) a non-conductive surface layer covering the entire outer surface of the disconnect means for preventing high voltage from passing from the transit rail vehicles to and from the power system to the hook means and thence to the hands of the user.

8. A method of disconnecting high voltage equipment in the presence of live source of high voltage comprising;

a) providing a first vehicle with a first mechanical coupling means and a second vehicle with a second mating mechanical coupling means;

b) providing an operating lever extending from the first mechanical coupling means.

c) mechanically engaging the first coupling means with the second coupling means to hold the two vehicles in mechanical connection;

d) manually grasping an elongated, electrically non-conductive disconnect tool by a pair of handles, engaging the operating lever extending from the first coupling means with the hook end of the disconnect tool for moving the operating lever between a connected position and a disconnected position, pulling the disconnect tool outwardly causing the first coupling means to uncouple from the second coupling means.

* * * * *